United States Patent [19]

Demo

[11] Patent Number: 4,682,443

[45] Date of Patent: Jul. 28, 1987

[54] REMOVABLE SELF-CONTAINED FLOOD PROTECTION DEVICE AND METHOD OF INSTALLATION

[76] Inventor: Elmer W. Demo, 13723 Lower Huntington Rd., Roanoke, Ind. 46783

[21] Appl. No.: 866,201

[22] Filed: May 21, 1986

[51] Int. Cl.[4] ..... E05B 7/18

[52] U.S. Cl. ..... 49/466; 49/70; 49/477

[58] Field of Search ..... 49/477, 70, 466

[56] References Cited

U.S. PATENT DOCUMENTS

| | | | |
|---|---|---|---|
| 2,763,038 | 9/1956 | Hagerty et al. | 20/69 |
| 3,311,042 | 3/1967 | Severson | 98/6 |
| 3,424,222 | 1/1969 | Stoner et al. | 49/477 X |
| 3,796,010 | 3/1974 | Carlson | 49/477 |
| 3,861,081 | 1/1975 | Maskell | 49/70 |
| 3,863,275 | 2/1975 | Brendgord et al. | 4/173 |
| 4,040,210 | 7/1977 | Land | 52/2 |

FOREIGN PATENT DOCUMENTS

| | | | |
|---|---|---|---|
| 1034106 | 7/1954 | Fed. Rep. of Germany | 49/477 |
| 2468715 | 5/1981 | France | 49/477 |

*Primary Examiner*—Kenneth Downey

*Attorney, Agent, or Firm*—Jeffers, Hoffman & Niewyk

[57] ABSTRACT

A removable temporary flood protection device which, when installed in a building doorway, provides a substantially water-tight barrier to entry of flood water through the doorway opening. The flood protection device includes an inner water resistant rigid core and an outer inflatable flexible seal tube. The inner core has a bottom and spaced apart sides which respectively extend generally parallel to the doorsill and door jambs of the doorway and are spaced upwardly and inwardly thereof so that the inner core extends across a lower portion of the doorway opening and thereby providing partial closure thereof except for a narrow space defined between the bottom and sides of the inner core and the doorsill and door jambs of the doorway. The inflatable seal tube is attached to a top of the inner core and extends down along the spaced sides and across the bottom thereof so that the seal tube is located in the narrow space defined between the inner core and the doorway. Once inflated, the seal tube is disposed at its inner side in sealing contact with the bottom and sides of the inner core and at its outer side in sealing contact with the doorsill and door jambs of the doorway thereby forming a substantially water-tight seal in the narrow space defined between the inner core and lower portion of the doorway opening for completing closure thereof.

4 Claims, 5 Drawing Figures

REMOVABLE SELF-CONTAINED FLOOD PROTECTION DEVICE AND METHOD OF INSTALLATION

BACKGROUND OF THE INVENTION

1. Field of the Invention

The present invention generally relates to flood damage prevention and, more particularly, is concerned with a removable flood protection device which is a self-contained unit adapted for temporary emergency use in doorways of homes and commercial buildings and is also concerned with a method of installing such device.

2. Description of the Prior Art

Extensive damage to the interiors, furnishings and equipment of homes and commercial buildings can result from flood water inundation of only moderate depth, for instance, from only a few inches to less than a foot. Moderate flooding in this range occasionally occurs, and in some cases recurs, in many localities of the country, causing great hardship and financial loss.

Different approaches to preventing inundation of flood water are known in the prior art. The traditional approach is to use bags filled with sand to build a dike about the perimeter of the building. However, this approach is costly in terms of the time, materials and transportation required to bag the sand, haul it to the building to be protected, and unload the bags and build the dike. Furthermore, this flood prevention method is very time consuming. Another less costly variation of this approach is to only build sand bag barriers around the doorways of the building. However, the construction of an adequate seal using sand bags requires skill and care in the placement of each bag. Also, with both of these approaches, a considerable amount of sand must be on hand before the flood waters rise and must be disposed of after the flood waters have receded. Further, the amount of labor involved with this method of flood prevention is considerable. Lastly, this method of flood prevention is very time consuming and, therefore, is not always feasible to be used on short notice.

Another approach is to permanently install a conversion channel or frame about the lower portion of the building doorway and then keep a removable panel on hand for insertion into the frame in order to quickly provide a barrier across the lower portion of the access opening to the entry of flood water. Representative of this approach are the arrangements disclosed in U.S. patents to Carlson (U.S. Pat. No. 3,796,010) and Maskell (U.S. Pat. No. 3,861,081). While these arrangements appear to have advantages over the traditional sand bag approach, they embody common shortcomings which make them less than an optimum solution to prevention of flood damage. In addition to the above-mentioned two basic components, each of the arrangements requires the application of labor, tools and materials for accomplishing permanent installation of the conversion frame and thus a high initial investment cost. The permanently installed conversion frame must be sealed to the building structure surrounding the lower portion of the doorway in addition to the removable panel forming an effective seal when inserted in the frame. Since the frame is located outdoors, it will be subject to weathering and serve as a collector of dirt and other foreign matter and debris which could ultimately undermine its reliability and workability. Therefore, maintenance must be carried out periodically with respect to the seal between the frame and building to ensure its adequacy when a flood condition does arise. Further, the permanently installed frame will likely pose a constant safety hazard to persons entering and exiting the doorway.

Consequently, a need still exists for a different approach to flood damage prevention, one which will provide an effective barrier to entry of flood water but, at the same time, not require the high costs of permanent installation and periodic maintenance nor involve the risk of injury to persons using the doorway or damage to their clothing by the protruding permanent conversion frame once the flood emergency is over, and which may be used effectively and quickly if little advance warning is available.

SUMMARY OF THE INVENTION

The present invention provides a removable flood protection device designed to satisfy the aforementioned needs. The flood protection device of the present invention is a self-contained unit adapted for temporary emergency use in a doorway. Its use requires no permanently installed parts. Instead, it is easy to install in the existing frame of the door by practically any person. Further, it may be installed quickly. The person is not required to have or use any special tools to accomplish the task, and needs to have no more facility with mechanical devices than that required to operate a source of pressurized air, such as an ordinary bicycle tire pump. Since the flood protection device is removed and stored when not in use, it does not present a hazard to persons using the doorway once the flood emergency is over and is not subject to deterioration due to exposure to the outside environment. The only maintenance required is to dry it after each use and also check it to ensure that its inflatable seal has not been punctured.

Accordingly, the present invention is directed to a removable temporary flood protection device for installation in a doorway including a bottom doorsill and two spaced apart door jambs extending upwardly from opposite ends of the doorsill so as to define a lower portion of a doorway opening above the doorsill and between the door jambs. The flood protection device, in one form thereof, comprises: (a) an inner core; and (b) an outer resilient seal member. The inner core has a bottom and spaced apart sides which respectively extend generally parallel to the doorsill and door jambs of the doorway and are respectively spaced generally upwardly and inwardly thereof so that the inner core extends generally across the lower portion of the doorway opening for providing partial closure thereof except for a narrow space defined correspondingly between the bottom and sides of the inner core and the doorsill and door jambs of the doorway when the device is installed in the doorway. The outer resilient seal member is attached to the inner core and extends along the bottom and spaced apart sides thereof so that the seal member is located in the narrow space defined between the bottom and sides of the inner core and the doorsill and door jambs of the doorway and is disposed at its inner side in sealing contact with the bottom and sides of the inner core and at its outer side in sealing contact with the doorsill and door jambs of the doorway when the device is installed in the doorway. In such an arrangement, the inner core and outer seal member provide a substantially water-tight seal in the narrow space defined between the inner core and the lower portion of the doorway opening for completing closure thereof.

More particularly, in one form of the invention, the inner core has spaced apart front and rear edges which extend outwardly beyond the bottom and sides of the core so as to define a continuous outwardly-opening channel extending along the bottom and sides of the core along which the seal member extends and within which it is seated. Further, the resilient seal member is an inflatable tube attached at its opposite ends to the inner core top and having an inflation valve attached adjacent to one of its opposite ends at the core top. Still further, in one form of the invention, the inner core is composed of, and the bottom, top and spaced apart sides thereof are defined respectively by, a bottom beam, a top beam and a pair of spaced apart side beams being rigidly interconnected in a generally rectangular configuration. Yet further, the inner core is also composed of front and rear spaced water resistant panels attached to and enclosing the bottom, top and spaced apart side beams of the core. The panels have peripheral edges which extend outwardly beyond the bottom and spaced apart side beams so as to define the continuous outwardly-opening channel extending along the bottom and sides of the core in which the inflatable seal tube is seated.

The present invention, in one form thereof, further relates to a method of installing a substantially water-tight barrier in a lower portion of a doorway opening defined by a bottom doorsill and two spaced apart door jambs extending upwardly from opposite ends of the doorsill. The method comprises the steps of: (a) placing in the doorway opening an inner water resistant core having a bottom and spaced apart sides which respectively extend generally parallel to the doorsill and door jambs of said doorway and are respectively spaced generally upwardly and inwardly thereof so that the inner core extends generally across the lower portion of the doorway opening and provides a partial closure thereof except for a narrow space defined correspondingly between the bottom and sides of the inner core and the doorsill and door jambs of the doorway; and (b) inflating an outer inflatable resilient seal member attached to the inner core and extending along the bottom and spaced apart sides thereof so that the seal member is located in the narrow space defined between the bottom and sides of the inner core and the doorsill and door jambs of the doorway and is disposed at its inner side in sealing contact with the bottom and sides of the inner core and at its outer side in sealing contact with the doorsill and door jambs of the doorway and thereby forms a substantially water-tight seal in the narrow space defined between the inner core and the lower portion of the doorway opening which completes closure thereof.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course, of the following detailed description, reference will be made to the attached drawings in which.

DETAILED DESCRIPTION OF THE INVENTION

Figure 1:
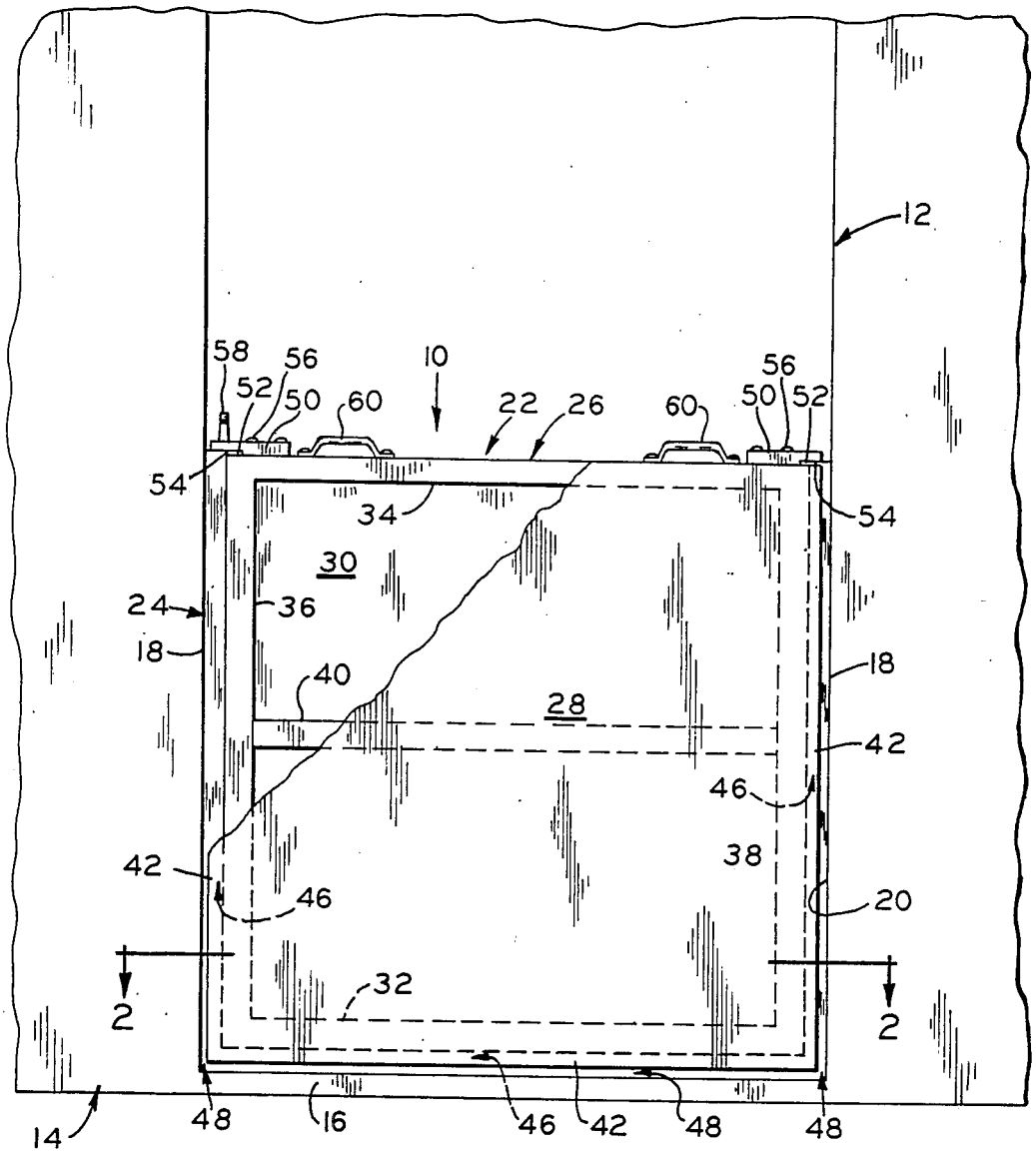
FIG. 1 is a front elevational view of a flood protection device constructed in accordance with the present invention shown mounted in an operative sealing position across a lower portion of a building doorway.
Figure 2:
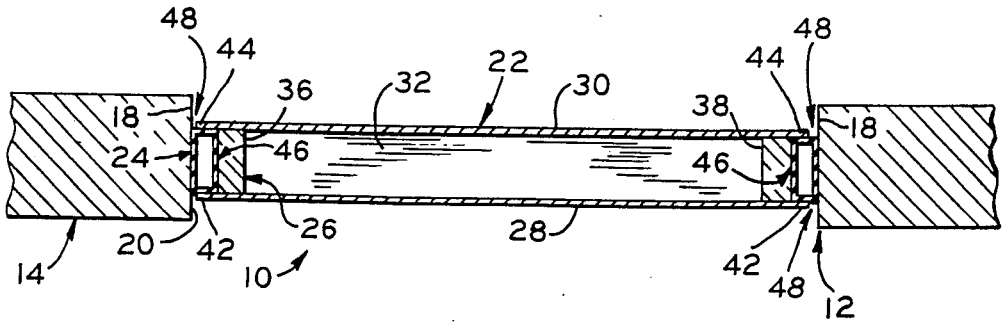
FIG. 2 is a cross-sectional view of the device as taken along line 2—2 of FIG. 1.

Referring now to the drawings, and particularly to FIGS. 1 and 2, there is shown a removable self-contained flood protection device generally designated by the numeral 10 and constituting the preferred embodiment of the present invention. The flood protection device is shown, in FIG. 1, operatively installed in a doorway 12 of a building structure 14. As conventionally constructed, the doorway 12 includes a bottom doorsill 16 and two spaced apart door jambs 18 extending upwardly from opposite ends of the doorsill 16. A lower portion of a doorway opening 20 is thus defined above the doorsill 16 and between the door jambs 18 across which the device 10 is intended to provide a substantially water-tight barrier against entry of flood water through the doorway 12.

Figure 3:
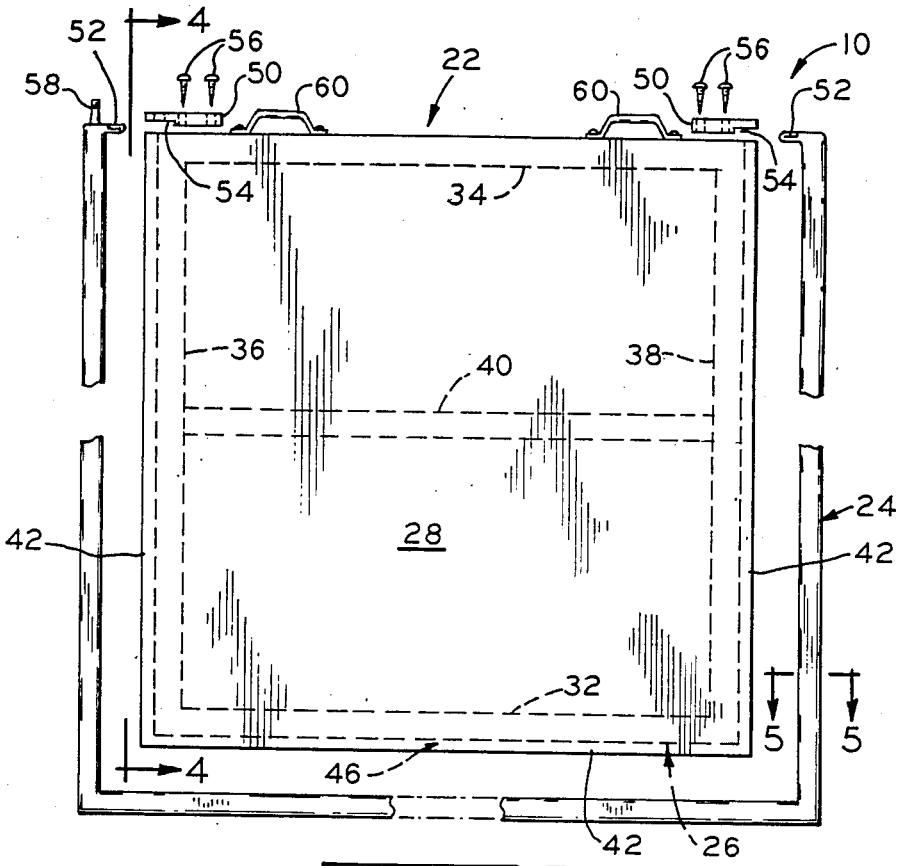
FIG. 3 is a front elevational view of the device similar to FIG. 1, but showing the components of the device in disassembled, exploded form.
Figure 4:
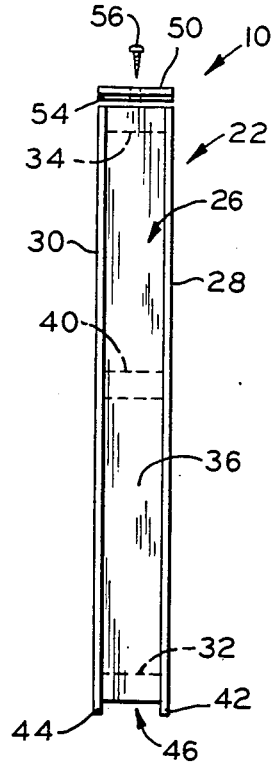
FIG. 4 is a side elevational view of the inner core of the device as seen along line 4—4 of FIG. 3.
Figure 5:
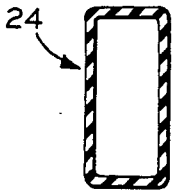
FIG. 5 is an enlarged cross-sectional view of the outer inflatable seal tube of the device as taken along line 5—5 of FIG. 3.

Turning also to FIGS. 3 to 5, the basic components of the flood protection device 10 are seen to include a substantially rigid water resistant inner core 22 and an outer inflatable seal member 24 in the form of a hollow resilient tube composed of a flexible material, for example, of rubber or plastic. While an inflatable tube 24 is shown in the preferred embodiment, it should be understood that other resilient sealing devices could be used, for instance, a soft rubber strip of material. The inner core 22 is composed of a structural frame 26 sandwiched between a pair of generally planar water resistant panels 28 and 30. The frame 26 laminated on its front and rear with the panels 28, 30 provides the rigidity and strength of the core, whereas the water resistant panels 28, 30 provide a partial closure for the doorway opening 20. The panels 28, 30 may be fabricated from any suitable material, such as wood, metal or plastic, so long as it is substantially water resistant. It should also be noted that core 22 may be comprised of an inner panel or slab of material to which a pair of outer panels 28 and 30 are secured. For example, the inner panel could be constructed of a rigid foam panel to support the outer panels 28 and 30.

More particularly, the structural frame 26 of the inner core 22 is constituted by a bottom beam 32, a top beam 34 and a pair of spaced apart side beams 36 and 38, all of which are rigidly interconnected together end-to-end in a generally rectangular configuration. For extra reinforcement, it is desirable to provide at least one cross beam 40 in the frame 26, for instance, extending between and rigidly interconnecting the spaced apart left and right side beams 36, 38. The beams 32, 34, 36, 38, 40 can be fabricated from any suitable material, although wood is preferred.

The front and rear panels 28, 30 are then respectively attached to the front and rear surfaces of the beams 32, 34, 36, 38, 40 which respective surfaces are generally aligned in common front and rear planes. To avoid unnecessary penetrations through the panels 28, 30 in the manufacture of the device 10 which would then have to be sealed, it is preferable to glue the panels 28, 30 to the frame 26. This may be readily accomplished by using any one of a variety of suitable commercially-available adhesives. Preferably the glue should be water resistant. Also, the device 10 is reversible in the sense that either one of its panels 28 or 30 is adapted to face toward the outside of the building structure and to contact the flood water.

As clearly shown in FIGS. 1 and 2, the height and width of the panels 28, 30 are selected relative to the height and width of the frame 26 so that the front and rear spaced panels will have peripheral marginal front and rear spaced edges 42 and 44 at the bottom and sides of the inner core 22 which extend outwardly beyond the bottom and side beams 32, 36, 38 of the frame 26. The front and rear spaced peripheral edges 42, 44 of the panels 28, 30 together with the outer surfaces of the bottom and side beams 32, 36, 38 of the structural frame 26 thereby define a continuous outwardly-opening channel 46 which extends along the bottom and sides of the core 22, the purpose of which is to seat the seal tube 24.

With respect to any given doorway 12, the bottom and sides of the particular inner core 22 intended for use in that doorway will extend generally parallel to the doorsill 16 and door jambs 18 of the doorway 12, but the width of the panels 28, 30 of such inner core 22 will be slightly shorter than the distance between the door jambs 18, or the width of the doorway opening 20, so that the bottom and sides of the inner core 22 are intentionally capable of being respectively spaced generally upwardly and inwardly of the doorsill 16 and door jambs 18. In such manner, the inner core 22 can easily be placed across the doorway opening 20, but will deliberately only provide a partial closure of the lower portion of the doorway opening 20. As seen in FIGS. 1 and 2, a narrow gap or space 48 is left about the inner core 22 between its bottom and sides and the doorsill 16 and door jambs 18 of the doorway 12.

The other basic component of the device 10, the outer inflatable seal tube 24, is adapted to fill the space 48. The seal tube 24 is generally attached to the top of the inner core 22 and extends along the bottom and spaced apart sides of the core 22 within the continuous channel 46 extending between the front and rear peripheral edges 42, 44 of its front and rear panels 28, 30. More specifically, the top beam 34 of the structural frame 26 defines the top of the inner core 22, and, as will become apparent upon comparing of FIG. 3 with FIG. 1, a pair of connectors 50 are provided for clamping the folded lip ends 52 of the seal tube 24 to the opposite end of the top beam 34. The connectors 50 are disposed on the top beam 34 of the inner core structural frame 26 adjacent the respective opposite ends of the top beam 34 and opposite ends 52 of the tube 24. Each of the connectors 50 is undercut at its outwardly extending portion so that, in conjunction with the opposite ends of the top beam 34, grooves 54 are defined in which the respective opposite tube ends 52 can be received. Thus, when each connector 50 is rigidly attached by screws 56 to the top beam 34, the one tube end 52 is clamped in the groove 54 and thereby sealed and firmly anchored to the inner core 22. Since the connectors 50 provide the only attachment between the tube 24 and the inner core 22, the tube 24 can easily be replaced by merely removing the connectors 50. Also, the inflatable tube 24 has an air filling or inflation valve 58 attached adjacent to one of its opposite ends 52 at the left top end of the inner core 22. The valve 58 is preferably of the type which can be connected to a conventional bicycle hand or foot operated air pump.

It will, therefore, be understood that the inflatable seal tube 24 when deflated is advantageously located in the channel 46 and faces the narrow space 48 defined between the bottom and sides of the inner core 22 and the doorsill 16 and door jambs 18 of the doorway 12. In such position, the tube 24 is essentially shielded by the panel edges 42, 44 from external contacts which could cause rupture of the tube. Then, upon being inflated, the seal tube 24 will extend across the narrow space 48, and at its inner side make sealing contact with the exterior surface of the bottom beam 32, or the bottom of the inner core 22, and with the exterior surfaces of the side beams 36, 38, or the sides of the inner core 22, whereas at its outer side the tube 24 will be making sealing contact with the doorsill 16 and door jambs 18 of the doorway 12 as well as sealably fill the corners formed at the opposite ends of the doorsill 16 by the door jambs 18. In such arrangement, a substantially water-tight pneumatic seal is formed in the narrow space 48 defined between the inner core 22 and the lower portion of the doorway opening 20 whereby a complete closure thereof is now effectuated by the self-contained flood protection device 10 formed by the interconnected inner core 22 and the seal tube 24.

OPERATION

Upon learning of approaching flood water, the user can quickly and advantageously install the device 10 in a doorway 12 or other comparable access opening in his or her home or office to provide a substantially water-tight barrier to the entry of flood water through the opening. Installation can be accomplished quickly and without the need for any tools or special skill. The only accessory used is a conventional air pump, the kind used to pump air into a bicycle tire.

The first step in installing the device 10 is to merely place it, with its tube 24 deflated, in the center of the lower portion of the doorway opening 20. Then, while holding it in such position and with the hose of the pump (not shown) connected to the air valve 58 of the device 10, the next step is to begin inflating the tube 24 by pumping air into it.

As soon as the expanding tube 24 makes contact with the door jambs 18, the device 10 can be released. Pumping is continued until inflation of the tube 24 is as complete as possible. One test to determine when such condition has been reached is to attempt to pull the device 10 from the doorway 12. If the device 10 cannot be removed after exertion of reasonable pulling force, then the pneumatic seal thus provided should be sufficient to resist flood water of moderate depth.

When the flood water has receded and use of the device 10 is no longer required, it can easily and quickly be removed by merely deflating the tube 24 and lifting the device out of the doorway 12. Handles 60 are conveniently mounted to the top beam 34 of the device 10 for use in both installing and removing the device.

It is thought that the flood protection device of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. A removable, temporary flood protection device for installation in a doorway having a bottom doorsill and two spaced-apart door jambs upwardly extending from opposite ends of the doorsill which doorsill and door jambs cooperate to define a lower portion of a doorway opening above said doorsill and between said door jambs, said flood protection device comprising:

an inner core having a bottom beam, a top beam spaced apart and generally parallel side beams and, said beams rigidly interconnected in a generally rectangular configuration;

front and rear water resistant panels attached to and enclosing said bottom, top and spaced apart side beams, said panels having peripheral edges extending outwardly from said bottom beam and each of said side beams to define a continuous outwardly-opening channel extending along said bottom and sides of said core;

an outer resilient sealing means extending along and seated in said channel, which sealing means contacts said doorsill and door jambs to seal said lower portion of said doorway and secure said protection device in said doorway;

wherein said resilient sealing means is an inflatable tube which includes an inflation valve adjacent one of its opposite ends at said top of said core.

2. The device as recited in claim 1, wherein said inner core is also composed of a cross beam extending between and rigidly interconnecting said spaced apart side beams.

3. A removable, temporary flood protection device as claimed in claim 1 further comprising anchoring means for securing said resilient sealing means to said core, which anchoring means is secured to said top beam.

4. The device as recited in claim 3 wherein said anchoring means comprises a pair of connectors disposed on the top of said core, adjacent respective opposite ends of said sealing means, each said connector forming a groove with said core top in which respective ends of said sealing means are received.

* * * * *